United States Patent [19]

Horn

[11] 3,960,204

[45] June 1, 1976

[54] LOW VOID VOLUME REGENERATOR FOR VUILLEUMIER CRYOGENIC COOLER

[75] Inventor: Stuart B. Horn, Fairfax, Va.

[73] Assignee: The United States of America as represented by the Secretary of the Army, Washington, D.C.

[22] Filed: Feb. 12, 1974

[21] Appl. No.: 441,914

Related U.S. Application Data

[62] Division of Ser. No. 253,742, May 16, 1972, abandoned.

[52] U.S. Cl. ..... 165/4; 165/10; 62/6

[51] Int. Cl.[2] ..... F28D 17/00

[58] Field of Search ..... 62/6; 165/4, 10

[56] References Cited

UNITED STATES PATENTS

| | | | |
|---|---|---|---|
| 1,863,586 | 6/1932 | Wilbe | 165/165 X |
| 2,451,629 | 10/1948 | McCollum | 165/154 X |
| 2,643,863 | 6/1953 | Buschow | 165/154 |
| 2,703,701 | 3/1955 | Simpelaar | 165/141 |
| 3,148,512 | 9/1964 | Hoffman et al. | 62/6 |
| 3,216,484 | 11/1965 | Gifford | 165/4 |
| 3,397,738 | 8/1968 | Daunt | 62/6 X |
| 3,692,095 | 9/1972 | Fleming | 62/6 X |

*Primary Examiner*—Albert W. Davis, Jr.
*Attorney, Agent, or Firm*—Nathan Edelberg; Milton W. Lee

[57] ABSTRACT

A low void volume regenerator for use in a Vuilleumier Cooler made by bonding alternating thin layers of copper and teflon and cutting radial slots into the regenerator.

7 Claims, 3 Drawing Figures

LOW VOID VOLUME REGENERATOR FOR VUILLEUMIER CRYOGENIC COOLER

The invention described herein may be manufactured, used, and licensed by or for the Government for governmental purposes without the payment to me of any royalty thereon.

This is a division of application Ser. No. 253,742, filed May 16, 1972, now abandoned.

BACKGROUND

The present invention is directed to a low void volume regenerator that can significantly improve the efficiency of a Vuilleumier (Vm) cooler.

Prior such coolers employed solid regenerators. However, lacking ample surface area, these solid devices are not very effective regenerators.

SUMMARY OF THE INVENTION

The present concept for a low void volume regenerator will produce a more effective regenerator; and one contributing to a longer cooler life as a result of the lower operating speed required of the cooler.

Heat is dissipated radially by the heat conductive device, for example, copper discs, as the gas passes through the longitudinal slots in the regenerator; the interspersed teflon layers retarding longitudinal heat flow therein.

DESCRIPTION OF THE PREFERRED EMBODIMENT

Figure 1:
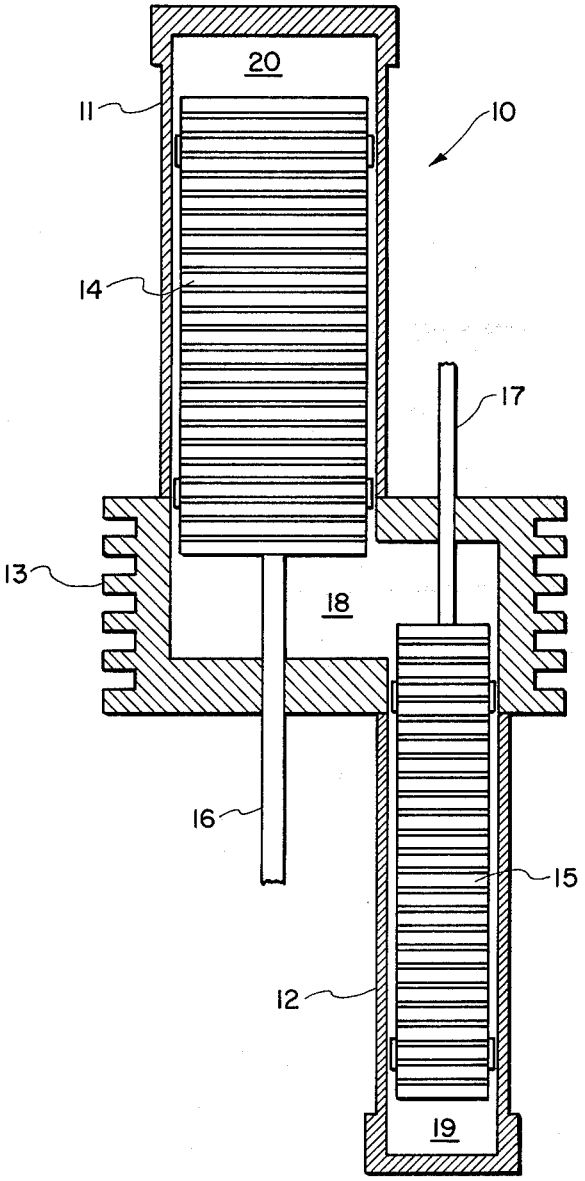
FIG. 1 shows the Vm cooler incorporating the instant low void volume regenerator.

Referring now to FIG. 1, the Vm cooler 10 comprises a hot cylinder 11, cold cylinder 12, ambient chamber 13 and a pair of low void volume regenerators 14 and 15 slidingly arranged in the hot and cold cylinders respectively. Means to transmit motion to the two regenerators 14 and 15 are shown at 16 and 17. The Vm cooler cycle is normally operated in such manner that a 90° phase difference between the piston motions of regenerators 14 and 15 is maintained. The motive means necessary to cyclically move the regenerator means 14 and 15 through means 16 and 17 are not shown as such means are conventional to this type of device. The Vm cooler cycle is described as follows:

Step 1: the hot regenerator 14 moves to the end of its compression stroke forcing the gas in the hot cylinder 11 to flow into the region 18 of the ambient chamber 13 causing the gas pressure therein to drop as the average gas temperature is reduced. At the same time, the cold regenerator 15 moves downward to midstroke causing work to be done on the gas in the refrigeration volume 19 of cylinder 12;

Step 2: the hot regenerator 14 now moves back to mid-stroke causing the gas to flow from the region 18 of the ambient chamber 13 to the hot temperature region 20 above regenerator 14 resulting in a slight increase in gas pressure. At the same time the cold regenerator 15 moves to the end of its compression stroke causing additional work to be done on the gas in the refrigeration volume 19 of cylinder 12;

Step 3: the hot regenerator 14 moves to the end of its stroke toward the ambient region 18 causing additional gas therein to flow to the hot temperature region 20 of cylinder 11 resulting in maximum gas pressure; since the average gas temperature is at the highest level at this time. Simultaneously the cold regenerator moves up to mid-stroke causing gas to flow into the refrigeration volume 19 below regenerator 15. At this time, the gas is doint work in the refrigeration volume 19 causing the temperature to drop;

Step 4: the hot regenerator 14 now moves up to mid-stroke, gas flows from the hot temperature region 20 to the region 18 and the pressure drops slightly. At the same time, additional gas flows from the ambient region 18 to the refrigeration volume 19 causing additional work to be done by the gas in the refrigeration volume 19.

The result is that gas in the refrigeration region does a net amount of work; therefore cooling results.

Figure 2:
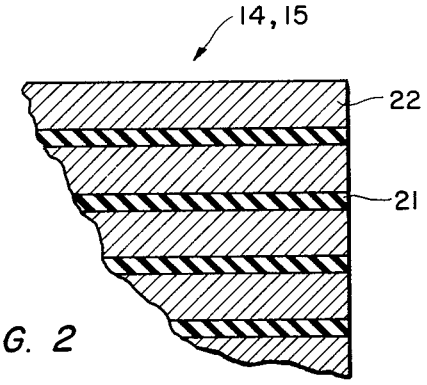
FIG. 2 is an enlarged view of a cross-section of the regenerator showing the disc-like members.

FIG. 2, an enlarged segment of a cross-section of either of the regenerators 14 and 15, shows the regenerator of the instant disclosure comprising alternating discs of insulating material 21 and heat conducting material 22, for example, teflon and copper for a cold regenerator or mica and copper for a hot regenerator, bonded together and having a total length $L_{RC}$. The thicknesses of the insulating and copper discs are designated $Y_T$ and $Y_M$ respectively. In the preferred embodiment, by way of example, the copper discs would be of 3 mil thickness and the teflon or mica discs would be 1 mil thick. The choice of the insulating material, naturally depending upon the high temperature environment to which the hot regenerator will be subjected.

Figure 3:
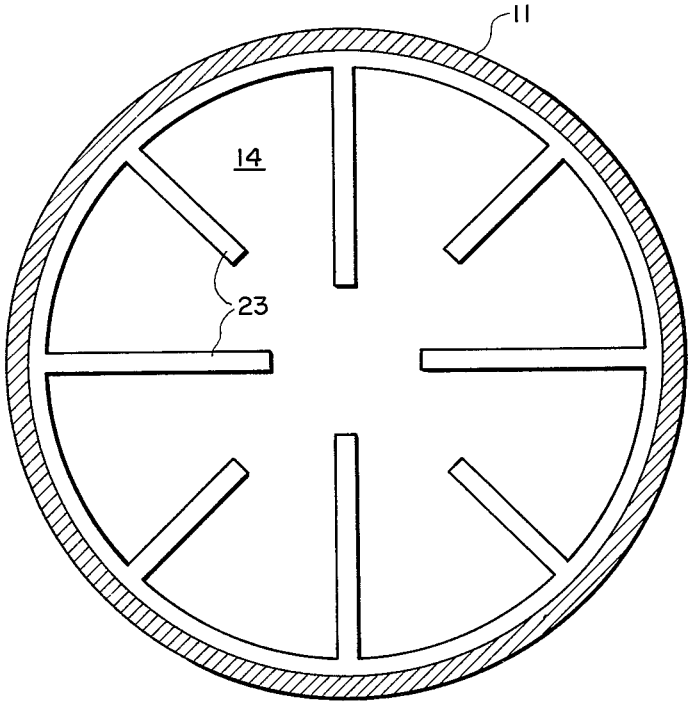
FIG. 3 is an end view of the regenerator showing a typical arrangement of the radial slots.

FIG. 3 is an end view of the regenerator 14, for example, showing the slot configuration of a preferred embodiment of the device. The slots 23, are alternating long and short radially positioned slots designated $L_1$ and $L_2$ respectively and having thickness $T_s$. The diameter of the regenerator is designated $D_i$; while the inside diameter of the cylinders 11 and 12 in which the regenerators are located is designated $D_o$.

The function of the regenerators 14 and 15 is to transfer and exchange heat from a gas used in a thermodynanic cycle. As the gas flows from the ambient temperature region to the cold temperature region the gas must give off its heat before it reaches the cold space. It does this by radially exchanging heat with the regenerator. On the way back from the cold space to the ambient space the gas must pick up the heat given off. When the gas returns to the ambient space it returns at nearly the temperature at which it started. The efficient regenerator will allow gas to flow from one volume to another with the minimum loss of heat to the regenerator. In reality the gas returns at a lower temperature and some net heat is dumped into the cold regenerator. This represents loss. The regenerator must also have a minimum longitudinal conductivity since this acts as a loss to the refrigeration space. The radial conductivity must be high and the surface area must be large to exchange heat efficiently. The voids in a regenerator create a loss in the refrigeration process. The gas in the void must also exchange heat and this loads the regenerator down since it must exchange gas with this additional mass that does not participate in the expansion process. The hot and cold regenerators work in the same manner.

In analyzing the instant device, four cold regenerator losses are identifiable and have been analyzed as follows:

1. regenerator heat transfer loss due to the finite film coefficients;
2. regenerator temperature swing loss which is due to the ineffective storage of heat from the gas during one cycle;
3. pressure drop loss due to the fluid friction of the gas as it moves through the regenerator; and
4. back conduction loss.

1. Heat Transfer Loss

The hydraulic radius is defined as the cross-sectional area divided by the wetted perimeter $$r_h = \frac{\frac{\pi}{4}[D_o^2 - D_i^2] + N_{s/2}\, T[L_1 + L_2]}{\pi D_o + \pi D_i + N_s[L_1 + L_2]} \quad (1)$$

The mass flux is $$G_c(\theta) = \frac{\dot{m}(\theta)}{\frac{\pi}{4}[D_o^2 + D_i^2] + N_{s/2}\, T[L_1 + L_2]} \quad (2)$$

The Reynolds number can now be found as $$N_{rec}(\theta) = \frac{G_c(\theta) 4 r_h}{M_{sc}} \quad (3)$$

where $M_{sc}$ is the viscosity of the gas at the cold temperature. The film coefficient based on the flow between infinite parallel plates where the Nusselt number is constant at 8.235 is $$h_c = \frac{8.235\, K_{sc}}{4 r_h} \quad (4)$$

where $k_{sc}$ is the thermal conductivity of the gas at the cold temperature. The regenerator net transfer units in the cold regenerator is $$NTU_c(\theta) = \frac{h_c(\theta) A_c}{m_c(\theta) C_{ps}} \quad (5)$$

where $C_{ps}$ is the specific heat of the gas. The regenerator inefficiency is then $$I_{cc}(\theta) = \frac{1}{1 + \frac{NTU_c(\theta)}{2}} \quad (6)$$

The heat transfer loss in the cold regenerator is then $$\dot{Q}_{CHT} = \frac{1}{2\pi} \int_{\theta_{m\,min}}^{\theta_{m\,max}} I_{cc}(\theta)(T_a - T_c) \frac{dm_c(\theta)}{dt} d\theta \quad (7)$$

2. Temperature Swing Loss

The second loss due to the temperature swing of the regenerator during the cycle is derived as follows. The assumption is that the regenerator has a linear temperature gradient from the ambient temperature $T_a$ to the cold temperature $T_c$. The steady state temperature in the semi-infinite solid which is heated at its face by a periodic flux $F_o \cos(t)$ is $$T = Fo/kk\ \sqrt{2} \cos(wt) \quad (8)$$

where

K is the thermal conductivity and $$k = \sqrt{\frac{\omega_p c_p}{2K}}$$

$$m_c = \frac{(m_{c\,max} - m_{c\,min})}{2}(1 + \sin\omega t) + m_{min} \quad (9)$$

$$\dot{m}_c = \frac{(m_c \max - m_{c\,min})}{2} \omega \cos \omega t \quad (10)$$

Now $A_c F_o \cos(t)$ is the heat flux and must equal $\dot{m}_c C_p (T_a - T_c)$. Solving for $F_o$ yields $$F_o = \frac{C_{pg}(T_a - T_c)(m_{c\,max} - m_{c\,min})\omega}{A_c} \quad (11)$$

The temperature swing is 2 times the amplitude $$\Delta T_s = \frac{2C_{pg}(T_a - T_c)(M_{c\,max} - M_{c\,min})2\pi N}{A_s K_s \sqrt{2}\left(\frac{\omega\ {}_s C_s}{2K_s}\right)^{1/2} + \left[A_c - \frac{\pi D_o^2}{4}\right] K_M \sqrt{2}} \Bigg/ \left(\frac{\omega\ {}_M C_M}{2K_M}\right)^{1/2} \left(\frac{Y_M}{Y_M + Y_T}\right) + \left[A_c - \frac{\pi D_o^2}{4}\right] K_T \sqrt{2} \left(\frac{\omega\ TC_T}{2K_T}\right)^2 \frac{Y_M}{Y_M + Y_T} \quad (12)$$

where $A_s$, $K_s$, $\rho_s$, $C_s$ is the surface area, thermal conductivity, density, and specific heat of the cold cylinder 12. $\rho_T$, $C_T$, $K_T$ are the properties of the teflon film and $\rho_M$, $C_M$, $K_M$ are the properties of the metal.

The cold temperature swing loss is then given by $$\dot{Q}_{cts} = N(M_{c\,max} - M_{c\,min}) C_{pg} \frac{\Delta T_s}{2} \quad (13)$$

3. Pressure Drop Loss

The third loss is the pressure drop loss. The friction factor is given as the one for laminar flow between two parallel plates.

$$f_c = \frac{24}{N_{rec}(\theta)} \quad (14)$$

$$\Delta P_c(\theta) = \frac{f_c(\theta) G_c(\theta)^2 L_{RC}}{2\rho_{mc}(\theta) r_h} \quad (15)$$

where $L_{RC}$ is the length of the regenerator, and $\rho_{mc}$ is the mean gas density which equals $$\rho_{mc} = \frac{2P(\theta)}{R(T_a + T_c)} \quad (16)$$

The pressure drop loss is then $$\dot{Q}_{PC} = \frac{1}{2\pi} \int_{\theta_{min}}^{\theta_{max}} \Delta P_c(\theta)\dot{V}_c(\theta)d\theta \quad (17)$$

4. Back Conduction Loss

The back conduction loss is the last loss and is given by $$\dot{Q}_{RC} = \frac{\pi K_{rg} D_i^2 (T_a - T_c)}{4} \quad (18)$$

where $K_{rg}$ is the effective longitudinal conductivity of the regenerator gas.

The regenerators 14, 15 are made out of 3 mil thick OFHC copper discs and 1 mil FEP teflon. The discs are alternated and sandwiched together in an aluminum mold. The mold is spring loaded to the ends and a slight pressure is applied to the layers. The mold is then placed in an oven at 575° F. The teflon bonds together the discs of copper. The regenerator is then machined down to the appropriate diameter and the radial slots are cut into the regenerator by a milling machine.

While the regenerator 14, 15 of the instant disclosure are shown having eight linear slots cut into the length of the bodies, other forms and number of slots, for example, slots formiing helical forming might be employed; and it is to be understood that variations, substitutions and alterations may be made while still maintaining the spirit and scope of the invention defined by the following claims.

I claim:

1. A low void volume regenerator for use in a Vuilleumier cooler and comprising:

a plurality of joined disc-like members forming an elongated body;

said disc-like members being made of heat insulating and heat conducting materials and being arranged to promote heat conduction radially of the regenerator body and to inhibit heat conduction longitudinally of the regenerator body; and a plurality of substantially radial slots in said regenerator body providing a low void volume for the passage of gas longitudinally therethrough.

2. The low void volume regenerator as in claim 1 wherein said slots are arranged symmetrically about the longitudinal axis of the regenerator body.

3. The low void volume regenerator as in claim 2 wherein said disc-like members are placed in alternating heat insulating and heat conducting sequence and wherein said heat conducting members are approximately three times the thickness of said heat insulating members.

4. The low void volume regenerator as in claim 3 wherein said slots form linear longitudinal paths through the regenerator.

5. The low void volume regenerator as in claim 3 wherein said slots form non-linear longitudinal paths through the regenerator.

6. The low void volume regenerator as in claim 5, wherein said non-linear paths are helical.

7. The low void volume regenerator as in claim 3 wherein said heat conducting material is copper and wherein said heat insulating material is selected from the group consisting of teflon and mica.

* * * * *